US012782019B2

(12) United States Patent
Zha et al.

(10) Patent No.: US 12,782,019 B2
(45) Date of Patent: Nov. 3, 2026

(54) QUICK CO2 WARM LIQUID DEFROST WITH ADDITIONAL HEAT

(71) Applicant: Heatcraft Refrigeration Products LLC, Stone Mountain, GA (US)

(72) Inventors: Shitong Zha, Snellville, GA (US); Ajay Iyengar, Frisco, TX (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 92 days.

(21) Appl. No.: 19/028,759

(22) Filed: Jan. 17, 2025

(65) Prior Publication Data

US 2026/0210601 A1 Jul. 23, 2026

(51) Int. Cl.
*F25B 47/02* (2006.01)

(52) U.S. Cl.
CPC ..... *F25B 47/02* (2013.01); *F25B 2347/02* (2013.01); *F25B 2600/25* (2013.01)

(58) Field of Classification Search
CPC ... F25B 47/02; F25B 2347/02; F25B 2600/25
See application file for complete search history.

(56) References Cited

U.S. PATENT DOCUMENTS 9,377,236 B2 * 6/2016 Hinde ..... F25D 21/06
2023/0408168 A1 * 12/2023 Zha ..... F25B 5/02

* cited by examiner

*Primary Examiner* — Nael N Babaa
(74) *Attorney, Agent, or Firm* — Baker Botts L.L.P.

(57) ABSTRACT

A refrigeration system includes a controller, a first evaporator, a second evaporator, one or more compressors, a flash tank, a heat exchanger, and four valves. When the controller determines that the first evaporator should be operated in a defrost mode, it operates the four valves to allow defrost refrigerant to pass from the heat exchanger to the first evaporator. The defrost refrigerant includes heat extracted from compressed refrigerant from the compressors, which is added to the heat in warm liquid received from the flash tank in order to defrost the first evaporator. Defrost refrigerant is caused to flow to the first exchanger, causing it to defrost, and the refrigerant is then passed to the second exchanger and to the compressors. When the second exchanger needs defrost, the valves are reversed, causing the defrost refrigerant to flow to the second exchanger and then to the first exchanger and the compressors.

20 Claims, 3 Drawing Sheets

QUICK CO2 WARM LIQUID DEFROST WITH ADDITIONAL HEAT

TECHNICAL FIELD

This disclosure relates generally to refrigeration systems. More particularly, in certain embodiments, this disclosure relates to quick carbon dioxide (CO2) warm liquid defrost with additional heat.

BACKGROUND

Refrigeration systems are used to regulate environmental conditions within an enclosed space. Refrigeration systems are used for a variety of applications, such as in supermarkets and warehouses, to cool stored items. For example, refrigeration systems may provide cooling operations for refrigerators and freezers.

SUMMARY OF THE DISCLOSURE

During the operation of refrigeration systems, ice may build up on evaporators. These evaporators then need to be defrosted to remove the ice buildup and prevent a loss of performance. Current defrost processes are limited in terms of their efficiency and effectiveness. For example, they may take a relatively long time and consume a relatively large amount of energy. Users of refrigeration systems typically want the defrost process to take less than thirty minutes. However, this is not always possible without adding additional components to the evaporators. Adding additional components is also not a desirable solution as it uses more energy, may potentially reduce the life of the evaporator and/or other components, and may cause an unacceptable change in the temperature of the environment being cooled by the evaporators.

This disclosure provides technical solutions to the problems of previous technology, including those described above. For example, a refrigeration system facilitates improved evaporator defrost using refrigerant from a flash tank maintained at a higher temperature using a heat exchanger during defrost operation. The refrigeration system includes a controller, a first evaporator, a second evaporator, one or more compressors, a flash tank, a heat exchanger, and four valves. When the controller determines that the first evaporator should be operated in a defrost mode, it operates the four valves to allow defrost refrigerant to pass from the heat exchanger to the first evaporator. The defrost refrigerant includes heat extracted from compressed refrigerant from the compressors, which is added to the heat in warm liquid from the flash tank to defrost the first evaporator. Defrost refrigerant is caused to flow to the first exchanger, causing it to defrost, and the refrigerant is then passed to the second exchanger and the compressors. When the second exchanger needs to defrost, the valves are reversed, causing the defrost refrigerant to flow to the second exchanger and then to the first exchanger and the compressors.

In an embodiment, a refrigeration system includes a plurality of evaporators, each configured to transfer heat from a space to a refrigerant. The plurality of evaporators includes at least a first low-temperature evaporator and a second low-temperature evaporator. The refrigeration system comprises one or more compressors configured to receive output refrigerant from the first low-temperature evaporator and the second low-temperature evaporator and output compressed refrigerant. The compressed refrigerant includes a first portion of compressed refrigerant and a second portion of compressed refrigerant. The system also includes a flash tank configured to receive the first portion of compressed refrigerant and output warm liquid condensed from the compressed refrigerant and a heat exchanger configured to receive the warm liquid from the flash tank and the second portion of the compressed refrigerant from the one or more compressors and provide defrost refrigerant to the plurality of evaporators. The heat exchanger extracts heat from the second portion of the compressed refrigerant and adds it to the warm liquid to produce the defrost refrigerant.

The refrigeration system also includes a first valve, a second valve, a third valve, a fourth valve, and a controller. The first valve is positioned between the heat exchanger and the first low-temperature evaporator and configured to pass, when open, defrost refrigerant to the first low-temperature evaporator. The second valve is positioned between the first low-temperature evaporator and the one or more compressors and configured to pass, when open, output refrigerant from the first low-temperature evaporator to the one or more compressors. The third valve is positioned between the heat exchanger and the second low-temperature evaporator and configured to pass, when open, defrost refrigerant to the second low-temperature evaporator. The fourth valve is positioned between the second low-temperature evaporator and the one or more compressors configured to pass when open, output refrigerant from the second low-temperature evaporator to the one or more compressors. The controller is communicatively coupled to the first valve, second valve, third valve, and fourth valve.

The controller is configured to determine that the first low-temperature evaporator should be operated in a defrost mode, and after determining the first low-temperature evaporator should be operated in the defrost mode, causes the first low-temperature evaporator to operate in the defrost mode. The controller opens the first valve to allow defrost refrigerant to pass to the first low-temperature evaporator, closes the second valve to prohibit output refrigerant from the first low-temperature evaporator from passing to the one or more compressors, closes the third valve to prohibit defrost refrigerant passing to the second low-temperature evaporator, and opens the fourth valve to allow output refrigerant from the second low-temperature evaporator to flow to the one or more compressors. This causes defrost refrigerant from the first low-temperature evaporator to flow to the second low-temperature evaporator.

The controller is further configured to determine whether the second low-temperature evaporator should be operated in a defrost mode. After determining the second low-temperature evaporator should be operated in a defrost mode, the controller causes the first valve to prohibit defrost refrigerant from passing to the first low-temperature evaporator, opens the second valve to allow output refrigerant from the first low-temperature evaporator to pass to the one or more compressors, opens the third valve to allow defrost refrigerant to pass to the second low-temperature evaporator, and closes the fourth valve to prohibit output refrigerant from the second low-temperature evaporator from flowing to the one or more compressors. This causes defrost refrigerant from the second low-temperature evaporator to flow to the first low-temperature evaporator.

In an embodiment, the one or more compressors comprise one or more low-temperature compressors and one or more medium-temperature compressors. The low-temperature compressors are configured to receive the output refrigerant from the plurality of evaporators, pass the first portion of compressed refrigerant to the medium-temperature compressors, and pass the second portion of compressed refrigerant to the heat exchanger. The medium-temperature compressors are configured to receive the second portion of compressed refrigerant and pass it to the flash tank.

In an embodiment, a three-way valve is positioned between one or more low-temperature compressors and the heat exchanger and configured to pass the second portion of compressed refrigerant from the low-temperature compressors to the heat exchanger and pass the first portion of compressed refrigerant to the medium-temperature compressors. The controller is communicatively coupled to the three-way valve and configured to determine a defrost time for the first low-temperature evaporator. The controller compares the defrost time to a predetermined threshold and causes the three-way valve to increase the compressed refrigerant provided to the heat exchanger when the defrost time exceeds the predetermined threshold.

In an embodiment, the system includes a first bypass valve, second bypass valve, third bypass valve, and a further bypass valve. The first bypass valve is positioned between the first valve and the first low-temperature evaporator. The second bypass valve is positioned between the first low-temperature evaporator and the second valve. The third bypass valve is positioned between the third valve and the second low-temperature evaporator. The fourth bypass valve is positioned between the second low-temperature evaporator and the fourth valve. When the controller determines that the operation of the first low-temperature evaporator is in a defrost mode, the controller causes the second bypass valve and the third bypass valve to open, which causes the defrost refrigerant from the first low-temperature evaporator to flow to the second low-temperature evaporator. When the controller determines that the operation of the second low-temperature evaporator is in a defrost mode, the controller causes the first bypass valve and the fourth bypass valve to open, which causes the defrost refrigerant from the second low-temperature evaporator to flow to the first low-temperature evaporator.

BRIEF DESCRIPTION OF THE DRAWINGS

For a more complete understanding of the present disclosure, reference is now made to the following description, taken in conjunction with the accompanying drawings in which.

DETAILED DESCRIPTION

Figure 1:
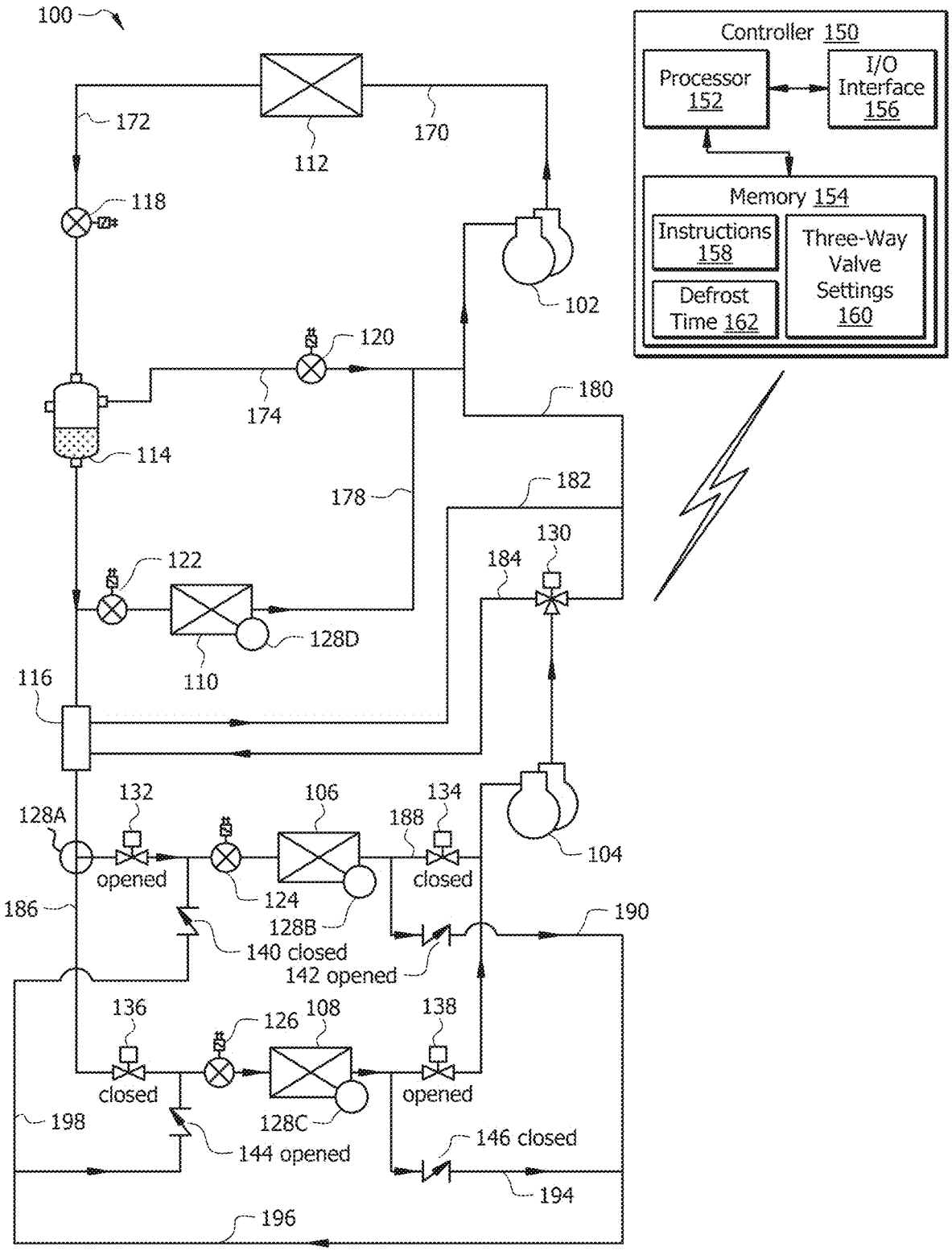
FIG. 1 is a diagram of an example refrigeration system of this disclosure configured to operate the first evaporator in a defrost mode.
Figure 2:
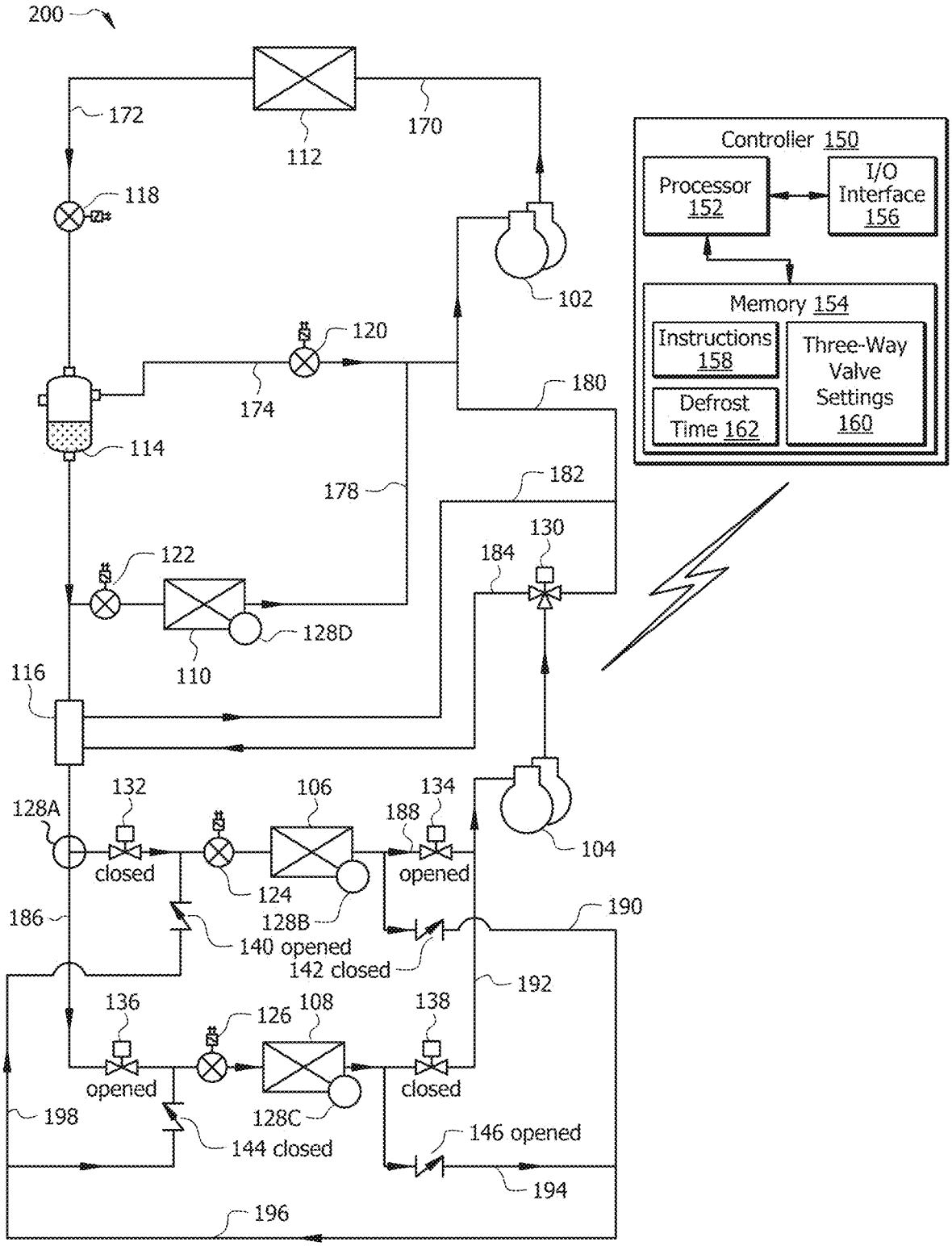
FIG. 2 is a diagram of the example refrigeration system of FIG. 1 configured to operate the second evaporator in a defrost mode.
Figure 3:
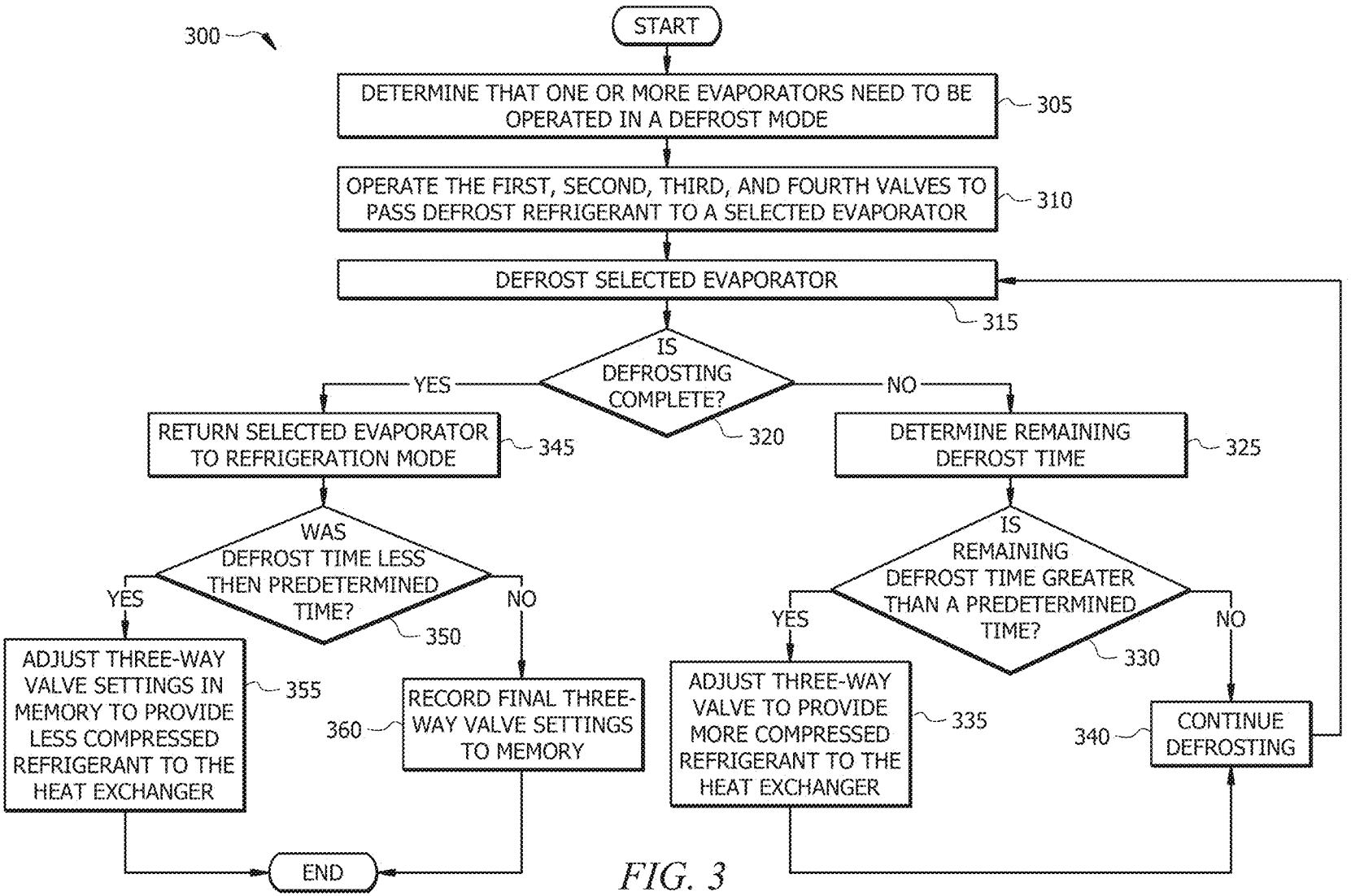
FIG. 3 is a flowchart of an example method of operating the refrigeration system of FIGS. 1 and 2 to provide improved evaporator defrost.

Embodiments of the present disclosure and its advantages are best understood by referring to FIGS. 1-3 of the drawings, like numerals being used for like and corresponding parts of the various drawings.

As described above, conventional refrigeration system defrost operations suffered from certain inefficiencies and drawbacks. This disclosure's refrigeration system improves defrost performance and energy efficiency. In one or more embodiments, the refrigeration system of this disclosure uses warm refrigerant received from the compressors and other components such as, but not limited to, a flash tank to defrost one or more evaporators. This warm refrigerant, however, does not always have sufficient heat to efficiently or timely defrost one or more evaporators. The disclosure utilizes a heat exchanger to heat the warm refrigerant to an ideal temperature by using some of the compressed refrigerants directly from the compressors to provide additional heat to the warm refrigerant. By controlling the amount of compressed refrigerant, the one or more evaporators may be defrosted more efficiently and timely within a user or organization's desired time period, such as but not limited to thirty minutes, without the need for additional electrical heat being applied directly to the coils or other components of the one or more evaporators.

In one or more embodiments, the refrigeration system of this disclosure may be a $CO_2$ refrigeration system. $CO_2$ refrigeration systems may differ from conventional refrigeration systems in that these systems circulate refrigerant that may become a supercritical fluid (i.e., where distinct liquid and gas phases are not present) above the critical point. For example, the critical point for carbon dioxide (CO2) is 31° C. and 73.8 MPa, and above this point, CO2 becomes a homogenous mixture of vapor and liquid called a supercritical fluid. This unique characteristic of transcritical refrigerants is associated with certain operational differences between transcritical and conventional refrigeration systems. For example, transcritical refrigerants are typically associated with discharge temperatures that are higher than their critical temperatures and discharge pressures that are higher than their critical pressures. When a transcritical refrigerant is at or above its critical temperature and/or pressure, the refrigerant may become a "supercritical fluid"—a homogenous mixture of gas and liquid. Supercritical fluid does not undergo a phase change process (vapor to liquid) in a gas cooler as occurs in a condenser of a conventional refrigeration system circulating traditional refrigerant. Rather, supercritical fluid cools down to a lower temperature in the gas cooler. Stated differently, the gas cooler in a $CO_2$ transcritical refrigeration system may receive and cool supercritical fluid, and the transcritical refrigerant undergoes a partial state change from gas to liquid as it is discharged from an expansion valve.

While in one or more embodiments, the refrigeration system of this disclosure is described as a $CO_2$ refrigerant system, the disclosure is not limited to a $CO_2$ refrigeration system. The refrigeration system may use other fluids with similar properties to $CO_2$. Alternatively, the refrigeration system of this disclosure may use any refrigerant or system that, combined with compressors and a plurality of valves, allows for defrosting one or more evaporators. In one or more embodiments, the refrigeration system does not need or use electrical heat directly applied to the evaporators. However, the disclosure is not limited to a system that does not use electrical heat. The disclosed method and system for defrosting the evaporators using the disclosed heat exchanged as will be described below with regards to FIGS. 1-3 may be combined or augmented by the use of additional electrical heating elements at the evaporators or at other positions without departing from the disclosure.

Refrigeration System

FIGS. 1 and 2 illustrate examples of refrigeration systems 100 and 200 configured for improved defrost operation. The refrigeration systems 100 and 200 include a first low temperature (LT) evaporator 106 and a second low temperature (LT) evaporator 108, along with one or more compressors, e.g., 102 and 104 and a flash tank 114. The refrigeration system 100, shown in FIG. 1, is configured to operate a first LT evaporator 106 in a defrost mode, while a second LT evaporator 108 is operated in a refrigeration mode. Similarly, the refrigeration system 200, shown in FIG. 2, is configured to operate the first LT evaporator 106 in a refrigeration mode while the second LT evaporator 108 is operated in a defrost mode. At least the first through fourth valves 132, 134, 136, and 138, and a three-way valve 130, are controlled by a controller 150. The systems 100 and 200 of FIGS. 1 and 2 may include more or fewer components than shown in FIGS. 1 and 2, and the disclosure is not limited to the number and specific components shown in FIGS. 1 and 2.

Refrigeration system 100 may include a plurality of compressors, e.g., 102 and 104. The one or more compressors, e.g., 102 and 104, may include one or more low-temperature (LT) compressors 104 and one or more optional medium-temperature (MT) compressors 102. In one or more embodiments, the MT compressor(s) 102 and LT compressor(s) 104 may be different types of compressors or maybe the same type of compressor. The optional MT compressor(s) 102 are configured to compress refrigerant discharged from the LT compressor(s) 104 via the three-way valve 130 as well as vapor discharged from the flash tank 114 and optional MT evaporator(s) 110. LT compressors 104 are configured to compress refrigerant discharged from one or more of the evaporators, e.g., 106.

Refrigeration system 100 may include any suitable number of MT compressors 102 and LT compressors 104. The MT compressor(s) 102 and LT compressor(s) 104 may vary by design and/or by capacity. For example, some compressor designs may be more energy efficient than other compressor designs, and some MT compressors 102 and LT compressors 104 may have modular capacity (e.g., a capability to vary capacity). The controller 150 communicates with the MT compressors 102 and LT compressors 104 and controls their operation.

The one or more LT compressors 104 receive refrigerant from the evaporators 106 and 108 after the refrigerant has been used to provide refrigeration through at least one evaporator, e.g., 108 and/or for defrosting at least one evaporator e.g., 106. The LT compressor(s) 104 compresses the refrigerant, and that refrigerant is provided to the three-way valve 130, where a first portion of the compressed refrigerant may be sent to a heat exchanger 116 through conduit 184, and the second portion may be sent through conduit 180 to the MT compressor(s) 102.

In one or more embodiments, the MT compressor(s) 102 provides supplemental compression to the second portion of the refrigerant discharged from the LT compressor(s) 104. The MT compressor(s) 102 may also receive refrigerant from the heat exchanger 116 through conduit 182 as well as discharge refrigerant from an optional medium temperature evaporator 110 through conduit 178 and vapor from the flash tank 114 through conduit 174. The received refrigerant which is warmer than that received by the LT compressor(s) 104, is then compressed by the MT compressor(s) 102 and provided to an optional gas cooler 112 through conduit 170.

The optional gas cooler 112 is configured to receive compressed refrigerant from the MT compressor(s) 102 through conduit 170. The gas cooler 112 is generally operable to apply cooling to the received compressed refrigerant. In some embodiments, gas cooler 112 is a heat exchanger comprising cooler tubes configured to circulate the received refrigerant and coils through which ambient air is forced. Inside gas cooler 112, the coils may absorb heat from the refrigerant, thereby cooling the refrigerant. The cooled compressed refrigerant is passed through conduit 172 to a flash tank 114.

Flash tank 114 is configured to receive mixed-state refrigerant and separate the received refrigerant into flash gas or vapor and warm liquid refrigerant. Flash tank 114 may include one or more tanks operable to hold refrigerant at least temporarily. Typically, the flash gas collects near the top of flash tank 114, and the liquid refrigerant is collected at the bottom of flash tank 114. A valve 118 may be disposed at or near an inlet of the flash tank 114 to reduce the pressure of refrigerant received by the flash tank 114.

In one or more embodiments the flash gas or vapor from the flash tank 114 is sent through an outlet through conduit 174 to the MT compressor(s) 102. In one or more embodiments the conduit 174 may include an optional valve 120 to reduce the pressure of the vapor directed from the flash tank 114 to the MT compressor(s) 102. Similarly, the warm liquid condensed from the flash tank 114 is directed to the heat exchanger 116 and an optional MT evaporator 110. The warm liquid directed towards the MT evaporator 110 may pass through a valve 122 which may be actuated to reduce the pressure of the refrigerant received by the MT evaporator 110.

The various conduits 170-198 may form a refrigerant conduit subsystem that facilitates the movement of refrigerant (e.g., $CO_2$) through a refrigeration cycle and defrost cycles, such that the refrigerant flows in the refrigeration mode, as illustrated by the arrows in FIGS. 1 and 2. The subsystem includes conduit, tubing, piping, and the like that facilitate the movement of refrigerant between components of the refrigeration system 100. The conduit 170-198 may be copper conduit or other types of appropriate conduit, tubing, or piping. Different sections of the conduit, e.g., 170 may be made of different materials or take different forms.

The warm liquid refrigerant from the flash tank 114 flows to and provides cooling to the evaporators 110, 106, and 108 when they are in refrigeration mode. Similarly, the warm liquid refrigerant may be used to defrost at least one evaporator, e.g., 106. Expansion valves 122, 124, and 126 may be operated to moderate the pressure of the warm liquid refrigerant to ensure proper operation of the evaporators 106-110.

In one or more embodiments a heat exchanger 116 is provided between the flash tank 114 and at least the low temperature (LT) evaporators 106 and 108. Conduit 186 connects the flash tank 114 to the LT evaporators 106 and 108 as well as the heat exchanger 116. In one or more embodiments the heat exchanger 116 may be placed prior to the optional MT evaporator 110 or may be after as shown in FIGS. 1 and 2. When placed after, as shown in FIGS. 1 and 2 the heat exchanger 116 only provides heat to the warm liquid that forms the defrost refrigerant that is passed through conduit 186 to the LT evaporators 106 and 108 during a defrost cycle.

Heat exchanger 116 is located downstream of the flash tank 114 and configured to receive the warm liquid refrigerant from the flash tank 114 and/or MT compressor(s) 102 and optional gas cooler 112. The heat exchanger 116 may include one or more tubes and/or coils that facilitate heat transfer from the compressed refrigerant received from the LT compressor(s) 104 through the three-way valve 130 through conduit 184 to the warm liquid refrigerant received from the flash tank 114. The heat exchanger 116, extracts the heat in the compressed refrigerant to add heat to the warm liquid refrigerant from the flash tank 114 to produce defrost refrigerant, and the defrost refrigerant is then output through conduit 186. The resulting heated refrigerant is provided to the LT evaporator(s) 106 and 108 operating in the defrost mode. FIG. 1 shows the example when the first LT evaporator 106 is operating in the defrost mode, while FIG. 2 shows the flow when the second LT evaporator 108 is operated in the defrost mode. In the examples shown in FIGS. 1 and 2 the opposite LT evaporator, e.g., 106 or 108 is then operated in refrigeration mode.

The optional MT evaporator 110 receives liquid refrigerant, which has not passed through the heat exchanger 116 from the flash tank 114 and uses the liquid refrigerant to provide cooling. For example, the MT evaporator 110 may be part of a refrigerated case and/or cooler for storing items that must be kept at particular temperatures. The refrigeration system 100 may include any appropriate number of MT evaporators 110 with the same or a similar configuration to that shown for the example MT evaporator 110 shown in FIGS. 1 and 2. The MT evaporator 110 may include an expansion valve 122 configured to receive the liquid refrigerant from flash tank 114 and reduce the pressure of the received refrigerant. In some embodiments, this reduction in pressure causes some of the refrigerant to vaporize. Expansion valve 122 may be configured to achieve a refrigerant temperature into the evaporator 110 at a predefined temperature for a given application (e.g., about −6° C.). Refrigerant from the MT evaporator 110 operating in refrigeration mode is provided to the one or more MT compressors 102.

The LT evaporators 106 and 108 are generally similar to the MT evaporator 110 but are configured to operate at lower temperatures then the MT evaporator 110 such as, for example, near about −30° C. or the like. Both the MT evaporator 110 and the LT evaporators 106 and 108 may be operated at any temperature and the disclosure is not limited to them operating at different temperatures or any particular temperature. The operation temperature is determined by the application as well as or instead, the preferences of the operator of the refrigeration system 100.

When operated in refrigeration mode the LT evaporators 106 and 108 both receive cooled liquid refrigerant from the flash tank 114 without additional heat being added by the heat exchanger 116. This cooled liquid refrigerant is used to provide cooling to an environment around each of the LT evaporators 106 and 108. For example, in a non-limiting example, the first LT evaporator 106 may be part of a deep freezer for relatively long-term storage of perishable items that must be kept at particular temperatures.

While the refrigeration system 100 is shown with only two LT evaporators, 106 and 108, the system 100 may include any appropriate number of LT evaporators, e.g., 106, with additional corresponding valves, e.g., 126, 136, and 144. For example, in a non-limiting example, a third LT evaporator (not shown) may be provided. When the first LT evaporator 106 is in a defrost mode, the second and third LT evaporators, e.g., 108, are caused to operate in a refrigeration mode. In another example, the first LT evaporator 106 and the second evaporator may be operated in a defrost mode, while the third LT evaporator is operated in a refrigeration mode. The first LT evaporator 106, second evaporator 108, and third LT evaporator (not shown) may be operated in refrigeration modes or defrost modes as appropriate, and any combination of LT evaporators in defrost modes and refrigeration modes may be used without departing from the disclosure.

The first LT evaporator 106 includes valves 132, 124, 140, 134, and 142 to facilitate the operation of the first LT evaporator 106 in either a defrost mode (see FIG. 1) or a refrigeration mode (see FIG. 2). Similarly, the second LT evaporator 108 includes valves 136, 126, 138, and 146 to facilitate the operation of the second LT evaporator 108 in either a refrigeration mode (see FIG. 1) or a defrost mode (see FIG. 2).

As shown in FIG. 1, when the first LT evaporator 106 is operated in the defrost mode, first valve 132 is opened and third valve 136 is closed. The closed third valve 136 prohibits defrost refrigerant from reaching the second LT evaporator 108. Alternatively, if both evaporators 106 and 108 are undergoing defrosting, the third valve 136 would also be opened, and the output from both evaporators 106 and 108 may be directed to additional evaporators (not shown) or to the LT compressor(s) 104. Warm liquid refrigerant is received from the heat exchanger 116 and used to defrost the first LT evaporator 106. Once the refrigerant is used by the first LT evaporator 106, the output refrigerant is then passed through the opened second bypass valve 142 into conduits 190 and 196 and then passes through expansion valve 126 to the second LT evaporator 108, where it is used to provide refrigeration to the environment surrounding the second evaporator 108. When providing refrigeration, the output refrigerant from the first LT evaporator 106 is used by the second LT evaporator 108 to transfer heat from the surrounding environment to the refrigerant. The resulting refrigerant is then passed through the open fourth valve 138 through conduit 192 to the one or more LT compressor(s) 104.

As shown in FIG. 2, when the second LT evaporator 108 is operated in the defrost mode, the first valve 132 is closed, and the second valve 136 is opened, while the third valve 134 is opened, and the fourth valve 138 is closed. Closing the first valve 132 prohibits defrost refrigerant from the heat exchanger 116 from reaching the first LT evaporator 108. Warm liquid defrost refrigerant is received from the heat exchanger 116 and used to defrost the second LT evaporator 108. Once the refrigerant is used by the second LT evaporator 108, it then passes through an opened fourth bypass valve 146 into conduit 194, 196, and 198 and then passes through the first open bypass valve 140, through the expansion valve 124 to the first LT evaporator 106 where it is used to provide refrigeration to the space or environment surrounding the first evaporator 106. When providing refrigeration, the output refrigerant from the second LT evaporator 108 is used by the first LT evaporator 106 to extract heat from the space or environment surrounding the first LT evaporator 106 to the refrigerant. The resulting refrigerant is then passed through conduit 188, the open second valve 134, and through conduit 192 to the one or more LT compressor(s) 104.

Expansion valves 124 and 126 may be an expansion valves that are the same as or are similar to expansion valve 122, described above. Expansion valves 124 and 126 may be configured to receive liquid refrigerant from the flash tank 114 or from a LT evaporator, e.g., 106 undergoing defrosting, and reduce the pressure of the received refrigerant. In some embodiments, this reduction in pressure causes some of the refrigerant to vaporize. Valves 124 and 126 as well as 122 may be any appropriate motorized or electronically controllable valves, such as motorized ball valves, solenoid valves, and/or the like. The controller 150 is in communication with valves 122-126 and controls their operation.

Similarly, first valve 132, second valve 134, third valve 136, and fourth valve 138 may be any appropriate motorized or electronically controllable valves, such as motorized ball valves, solenoid valves, and/or the like. The controller 150 is in communication with valves 132-138 and controls their operation as is described above and will be described in more detail below with regards to FIG. 3. The controller 150 also controls first bypass valve 140, second bypass valve 142, third bypass valve 144, and fourth bypass valve 146 to direct the refrigerant from the LT evaporator, e.g., 106 undergoing defrosting, to the LT evaporator, e.g., 108 that is in a refrigeration mode. The bypass valves 140-146 may be any appropriate motorized or electronically controllable valves, such as motorized ball valves, solenoid valves, and/or the like. By directing the warm liquid refrigerant from the heat exchanger 116 first to a defrosting LT evaporator, e.g., 106 and then to an LT evaporator e.g., 108 that is being operated in a refrigeration mode, the resulting refrigerant may be efficiently used to both defrost the defrosting LT evaporator, e.g., 106 and the be used for refrigeration in the refrigeration LT evaporator, e.g., 108 increasing the efficiency and better utilizing the heat generated by the various components of the refrigeration system 100 and 200 of FIGS. 1 and 2.

A three-way valve 130 may be provided between the LT compressor(s) 104 and the heat exchanger 116. The three-way valve 130 is used to control the amount of compressed, heated refrigerant provided from the LT compressor(s) 104 to the heat exchanger 116 as well as a second portion provided to the MT compressor(s) 102. The controller 150, controls the three-way valve 130 based on the three-way valve setting 160 stored in memory 154. By increasing or decreasing the first portion of the compressed refrigerant received from the LT compressor(s) 104 and then through conduit 184 to heat exchanger 116, the amount of time it takes to defrost an LT evaporator, e.g., 106, may be increased or decreased. The specific amounts and time may be stored in a look-up table in the three-way valve settings 160 in memory 154.

Sensors 128A-128D may be provided to determine when the evaporators 106-110 need to be defrosted, as well as other information related to their operation. The sensors 128A-128D may take the form of temperature and/or pressure sensors and may be disposed on, in, or near the corresponding evaporators 106-110 or refrigerant conduit connected the heat exchanger 116 to the first LT evaporator 106 and second LT evaporator 108. Information from sensors 128A-128D may assist in determining when operation in defrost mode is appropriate or should be ended. For example, defrost mode operation may be indicated if the temperature and/or pressure measured by sensors 128B and 128C indicate potential freezing of one or more of the LT evaporators e.g., 106. Further, sensor 128A may determine when the heat of the warm liquid refrigerant from the heat exchanger 116 is sufficient to defrost an LT evaporator, e.g., 106, and/or when adjustments should be made to the three-way valve 130. Sensor 128A may be located on or adjacent to the heat exchanger 116, on or adjacent to the first valve 132, or at an intermediate position between the heat exchanger 116 and the first valve 132. While sensors 128A-128D are provided in one or more embodiments to determine when one or more evaporators 106-110 need to be defrosted, these sensors may not be necessary, and defrost mode operations may be completely determined by schedules and settings stored in the memory 154, without departing from the disclosure.

The components of the refrigeration system 100 and 200, may be controlled by the controller 150. The controller 150 may provide instructions for adjusting valves 118-146 to open or close to achieve the configurations described above for refrigeration and defrost mode operation. For example, instruction 158, implemented by processor 152 of the controller 150, may determine that the operation of the first LT evaporator 106 or second LT evaporator 108 should be in a defrost mode based on measurements from sensors 128A-128C or information stored in memory 154 such as schedule and/or three-way valve settings 160. For example, instruction 158, stored by controller 150, may indicate that defrost mode operation is needed on a certain schedule or at a certain time.

The controller 150 adjusts the operation of components of the refrigeration systems 100 and 200 to operate the LT evaporators 106 and 108 in a refrigeration mode or a defrost mode, as described herein. The controller 150 includes a processor 152, memory 154, and input/output (I/O) interface 156. The processor 152 includes one or more processors operably coupled to the memory 154. The processor 152 is any electronic circuitry including, but not limited to, state machines, one or more central processing unit (CPU) chips, logic units, cores (e.g., a multi-core processor), field-programmable gate array (FPGAs), application specific integrated circuits (ASICs), or digital signal processors (DSPs) that communicatively couples to memory 154 and controls the operation of the refrigeration system 100.

The processor 152 may be a programmable logic device, a microcontroller, a microprocessor, or any suitable combination of the preceding. The processor 152 is communicatively coupled to and in signal communication with the memory 154. The one or more processors are configured to process data and may be implemented in hardware or software. For example, the processor 152 may be 8-bit, 16-bit, 32-bit, 64-bit, or of any other suitable architecture. The processor 152 may include an arithmetic logic unit (ALU) for performing arithmetic and logic operations, processor registers that supply operands to the ALU and store the results of ALU operations, and a control unit that fetches instructions from memory 154 and executes them by directing the coordinated operations of the ALU, registers, and other components. The processor 152 may include other hardware and software that operates to process information, control the refrigeration system 100, and perform any of the functions described herein (e.g., with respect to FIGS. 1-3). The processor 152 is not limited to a single processing device and may encompass multiple processing devices. Similarly, the controller 150 is not limited to a single controller but may encompass multiple controllers.

The memory 154 may include one or more disks, tape drives, solid-state devices, or solid-state drives. The memory 154 may be used as an over-flow data storage device to store programs when such programs are selected for execution and to store instructions 158 and data read during program execution. The memory 154 may be volatile or non-volatile and may include ROM, RAM, ternary content-addressable memory (TCAM), dynamic random-access memory (DRAM), and static random-access memory (SRAM). The memory 154 is operable (or configured) to store information used by the controller 150 and/or any other logic and/or instructions for performing the function described in this disclosure.

The I/O interface 156 is configured to communicate data and signals with other devices. For example, the I/O interface 156 may be configured to communicate electrical signals with components of the refrigeration system 100, including but not limited to valves 132-138 and bypass valves 140-146. The I/O interface 156 may be configured to communicate with other devices and systems and is not limited to those just described or those present in FIGS. 1 and 2. The I/O interface 156 may provide and/or receive, for example, compressor speed signals, compressor on/off signals, valve open/close signals, temperature signals, pressure signals, temperature setpoints, environmental conditions, and an operating mode status for the refrigeration system 100 and 200 and send electrical signals to the components of the refrigeration system 100 and 200. The I/O interface 156 may include ports or terminals for establishing signal communications between the controller 150 and other devices. The I/O interface 156 may be configured to enable wired and/or wireless communications.

Although this disclosure describes and depicts refrigeration systems 100 and 200, including certain components, it recognizes that refrigeration systems 100 and 200 may include any suitable components. For example, refrigeration systems 100 and 200 may include one or more additional sensors configured to detect temperature and/or pressure information.

In an example operation of the refrigeration system 100, both LT evaporators 106 and 108 are initially operating in the refrigeration mode. As illustrated in FIG. 1, the first LT evaporator 106 is placed in a defrost mode by controller 150. In this mode, the first valve 132 is opened, the second valve 134 is closed, the third valve 136 is closed, and the fourth valve 138 is opened. Additionally, the first bypass valve 140 is closed, the second bypass valve 142 is opened, the third bypass valve 144 is opened, and the fourth bypass valve 146 is closed. Three-way valve 130 is adjusted to provide a first portion of the compressed refrigerant from the LT compressor 104 to the heat exchanger 116 to increase the temperature of the liquid refrigerant received from the flash tank 114. This warm liquid refrigerant passes through the opened first valve 132 to the first LT evaporator 106, which is then heated to perform defrosting by the warm liquid refrigerant; the refrigerant then passes through the open second bypass valve 142 and the third opened bypass valve to the second LT evaporator 106 which uses the refrigerant for refrigeration. The refrigerant then flows through the open fourth valve to the LT compressor 104.

At another point, as shown in FIG. 2, during the operation of the refrigeration system 200, the controller 150 determines that defrost mode operation is needed for the second LT evaporator 108. The first LT evaporator 106 is placed in refrigeration mode, and the second LT evaporator 108 is placed in defrost mode by the controller 150. In this mode, the first valve 132 is closed, the second valve 134 is opened, the third valve 136 is opened, and the fourth valve 138 is closed. Additionally, the first bypass valve 140 is opened, the second bypass valve 142 is closed, the third bypass valve 144 is closed, and the fourth bypass valve 146 is opened. As before, the three-way valve 130 is adjusted to provide a first portion of the compressed refrigerant from the LT compressor 104 to the heat exchanger 116 to increase the temperature of the liquid refrigerant received from the flash tank 114. This warm liquid refrigerant passes through the opened third valve 136 to the second LT evaporator 106, which is then heated to perform defrosting by the warm liquid refrigerant, the refrigerant then passes through the open fourth bypass valve 142 and the open first bypass valve 140 to the first LT evaporator 106 which uses the refrigerant for refrigeration. The refrigerant then flows through the open second valve to the LT compressor 104.

Example Method of Operation

FIG. 3 illustrates an example method 300 of operating the refrigeration system 100 described above with respect to FIGS. 1 and 2. The method 300 may be implemented using the processor 152, memory 154, and I/O interface 156 of the controller 150 of FIGS. 1 and 2. The method 300 may begin at operation 305.

In operation 305, the controller 150 determines if one or more of the LT evaporators 106 and 108 need to be operated in a defrost mode. This may be determined using the sensors 128B and 128C associated with one or more LT evaporators 106 and 108. Alternatively, sensors at the LT compressor(s) 104 or at other positions may determine the temperature or pressure associated with the discharge from the one or more LT evaporators 106 and 108, indicating that at least one of the LT evaporators, e.g., 106 may need to be defrosted. In yet another alternative, the determination to operate a selected at least one of the LT evaporators, e.g., 106 in a defrost mode, may be determined based on a predetermined schedule or another schedule, such as once every six hours, twelve hours, every day, every week, or any other schedule that a user, operator, installer, or manufacture deems appropriate to maintain the efficiency and/or life of the selected evaporator, e.g., 106.

Once the controller 150 determines that a selected evaporator, e.g., 106, needs to be operated in a defrost mode, the controller 150 causes the first valve 132, second valve 134, third valve 136, and fourth valve 138 to pass defrost refrigerant to the appropriate selected evaporator, e.g., 106, while passing refrigerant to at least one other evaporator 108 for operating the other evaporator 108 in a refrigeration mode in operation 310. For example, in one or more embodiments, when the first evaporator 106 is determined to need to be operated in a defrost mode, while the second evaporator 108 is operated in a refrigeration mode, first valve 132 is opened, the second valve 134 is closed, the third valve 136 is closed and the fourth valve 138 is opened as shown in FIG. 1. This allows the defrost refrigerant to defrost the evaporator 106 while using refrigerant to be used to continue providing refrigeration at the second evaporator 108. The refrigerant is then returned to the LT compressor(s) 104. In yet another example, one or more embodiments, when the second evaporator 108 is determined to need to be operated in a defrost mode, while the first evaporator 106 is operated in a refrigeration mode, first valve 132 is closed, the second valve 134 is opened, the third valve 136 is opened, and the fourth valve 138 is closed as shown in FIG. 2. The number of evaporators 106 and 108 is not limited to two and more than one evaporator; e.g., 106 and 108 may be operated simultaneously in defrost mode without departing from the disclosure.

Once controller 150 operates the valves, e.g., 132, to provide defrost refrigerant to one or more evaporators, the selected evaporator, e.g., 106, is defrosted in operation 315. This may include operating the first bypass valve 140, the second bypass valve 142, the third bypass valve 144, and the fourth bypass valve 146 to allow refrigerant to flow from the first evaporator 106 to the second evaporator 108 or when the selected evaporator, e.g., 108 is the second evaporator 108, operating the first bypass valve 140, second bypass valve 142, third bypass valve 144, and fourth bypass valve 146, to allow refrigerant to flow from the second evaporator 108 to the first evaporator 106.

Further, in one or more embodiments, the controller 150 may operate the three-way valve 130 to control the amount of compressed refrigerant that is sent to the heat exchanger 116. This may be done based on a table of defrost temperatures, times, and any other information stored in the memory 154 and updated as described above and below to ensure that the selected evaporator, e.g., 106 defrosts in a preferred or threshold predetermined amount of time.

The controller 150 then determines if the defrosting is complete in operation 320. In one or more embodiments, the controller 150 determines how long to operate the selected evaporator, e.g., 106 in a defrost mode based on defrost time 162 stored in the memory 154. This may be based on times determined by the manufacturer, experimental defrost cycles, or based on previous defrost cycles. Alternatively, or in addition, the controller 150 may use sensors 128B and 128C associated with the selected evaporator, e.g., 106, to determine if the defrosting is complete and/or if changes to the defrost cycle, such as, for example, adjusting the three-wave valve 130, are needed to meet a defrost time goal.

If controller 150 determines that defrosting is not complete in operation 320, then controller 150 determines in operation 325, the remaining defrost time, based on the rate that the sensors 128B or 128C indicate that the selected LT evaporator, e.g., 106 is undergoing defrosting. In operation 330, the controller 150 compares the remaining defrost time to a predetermined threshold and if controller 150 determines the remaining defrost time is greater than the threshold predetermined time, then method 300 proceeds to operation 335. The threshold predetermined time is the amount of time that a user or operator of the refrigeration system, e.g., 100, desires for a select evaporator, e.g., 106, to defrost. For example, an operator may desire for the first LT evaporator 106 to take thirty minutes to defrost, as this allows for defrosting without the environment in which the first LT evaporator 106 is cooling from getting too warm or exceeding refrigeration requirements. Alternatively, the threshold predetermined time may be determined by the manufacture of the refrigeration system, e.g., 100, or the manufacture of the evaporator, e.g., 106, based on performance structural and/or performance requirements for the evaporator, e.g., 106 and/or other parts of the refrigeration system, e.g., 100.

If the defrost time will be more than the threshold predetermined time, the controller 150 causes (e.g., adjusts) the three-way valve 130 to provide more compressed refrigerant to the heat exchanger 116 in operation 335, which will cause the select evaporator, e.g., 106, to defrost quicker. If the controller 150 in operation 330 determines that the defrost time is not more than a predetermined time or in operation 335, the three-way valve 130 is caused by the controller 150 to provide more compressed refrigerant, the controller causes the selected evaporator, e.g., 106 to continue defrosting in operation 340. The method 300 then returns to operation 315, and operations 315-340 are repeated until the defrosting is determined to be complete in operation 320.

If the defrosting is determined by the controller 150 to be complete in operation 320, the controller then adjusts the valves 132-138 and the select evaporator, e.g., 106, to be returned to the refrigeration mode in operation 345. In one or more embodiments, when the select evaporator, e.g., 106, is returned to refrigeration mode, the controller 150 may determine the total time for defrosting and then record any changes to the three-way valve 130 performed in operation 335 in the memory to update the three-way valve setting 160. In one or more embodiments, the controller 150 may also, optionally, determine if the defrost time was less than the predetermined time in operation 350.

If in operation 350 the controller 150 determines that the defrost time was less than the predetermined time, the controller 150 updates in operation 355 the three-way valve settings 160 in the memory to decrease the amount of compressed refrigerant to provide to the select heat exchanger e.g., 106 during future defrost cycles. The combination of operations 335 and 355 will cover multiple defrost cycles and determine the ideal three-way valve setting 160 that obtains defrost in the predetermined time period within at least an acceptable margin of error. For example, if the operator of the refrigeration system, e.g., 100, desires the defrost cycle to take place in 30 minutes, the acceptable margin of error may be selected by the operator or manufacturer to be within five minutes. These determinations in operations 335 and 355 may be made during testing at the manufacturer or may be obtained during real-world use of the systems 100 and 200.

Other margins of errors and predetermined times may be used without departing from the disclosure. The margin of error as well as predetermined times, may also change based on the use of the refrigeration system, e.g., 100, and the environment of the refrigeration system, e.g., 100. For example, a refrigeration system, e.g., 100, used to cool pharmaceuticals, may have a smaller margin of error than that of a system used to cool certain food items. In another example, the predetermined time may be adjusted based on humidity, time of day, and other factors that may affect the ability of the system to defrost in the predetermined amount of time or make longer or shorter predetermined amounts of time desirable from an efficiency or cost consideration.

If the controller 150 determines in operation 350 that the defrost time was not less than the predetermined time, in operation 360 the controller 150 then updates (e.g., records) the three-way valve settings 160 in the memory 154. Once either operation 355 or operation 360 is performed, method 300 then ends.

Method 300 may include more, fewer, or other operations. For example, operations may be performed in parallel or any suitable order. In one or more embodiments, the controller 150 may then repeat method 300 for one or more of the other evaporators, e.g., 108, or wait until a sensor, e.g., 128B associated with the evaporators, e.g., 106 and 108, indicates that defrosting is needed, or a predetermined time has passed since the last defrost cycle. Modifications, additions, or omissions may be made to method 300, depicted in FIG. 3. While at times discussed as controller 150, refrigeration system 100, or components thereof performing the operations, any suitable refrigeration system or components of the refrigeration system may perform one or more operations of method 300.

While several embodiments have been provided in the present disclosure, it should be understood that the disclosed systems and methods might be embodied in many other specific forms without departing from the spirit or scope of the present disclosure. The present examples are to be considered illustrative and not restrictive, and the intention is not to be limited to the details given herein. For example, the various elements or components may be combined or integrated into another system, or certain features may be omitted or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

To aid the Patent Office and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A refrigeration system, comprising:

a plurality of evaporators, each configured to transfer heat from a space to refrigerant, wherein the plurality of evaporators includes at least a first low-temperature evaporator and a second low-temperature evaporator;

one or more compressors configured to receive output refrigerant from the first low-temperature evaporator and the second low-temperature evaporator and output compressed refrigerant, wherein the compressed refrigerant comprises a first portion of compressed refrigerant and a second portion of compressed refrigerant;

a flash tank configured to receive the first portion of compressed refrigerant and output warm liquid condensed from the compressed refrigerant;

a heat exchanger configured to receive the warm liquid from the flash tank and the second portion of the compressed refrigerant from the one or more compressors and provide defrost refrigerant to the plurality of evaporators, wherein the heat exchanger extracts heat from the second portion of the compressed refrigerant and adds it to the warm liquid to produce the defrost refrigerant;

a first valve positioned between the heat exchanger and the first low-temperature evaporator and configured to pass, when open, defrost refrigerant to the first low-temperature evaporator;

a second valve positioned between the first low-temperature evaporator and the one or more compressors and configured to pass, when open, output refrigerant from the first low-temperature evaporator to the one or more compressors;

a third valve positioned between the heat exchanger and the second low-temperature evaporator and configured to pass, when open, defrost refrigerant to the second low-temperature evaporator;

a fourth valve positioned between the second low-temperature evaporator and the one or more compressors configured to pass, when open, output refrigerant from the second low-temperature evaporator to the one or more compressors; and a controller communicatively coupled to the first valve, second valve, third valve, and fourth valve, wherein the controller is configured to:

determine that the first low-temperature evaporator should be operated in a defrost mode; and after determining the first low-temperature evaporator should be operated in the defrost mode, cause the first low-temperature evaporator to operate in the defrost mode by:

opening the first valve to allow defrost refrigerant to pass to the first low-temperature evaporator;

closing the second valve to prohibit output refrigerant from the first low-temperature evaporator from passing to the one or more compressors;

closing the third valve to prohibit defrost refrigerant passing to the second low-temperature evaporator;

opening the fourth valve to allow output refrigerant from the second low-temperature evaporator to flow to the one or more compressors; and causing defrost refrigerant from the first low-temperature evaporator to flow to the second low-temperature evaporator.

2. The refrigeration system of claim 1, wherein:

the one or more compressors comprise one or more low-temperature compressors and one or more medium-temperature compressors;

the one or more low-temperature compressors are configured to:

receive the output refrigerant from the plurality of evaporators, pass the first portion of compressed refrigerant to the one or more medium-temperature compressors, and pass the second portion of compressed refrigerant to the heat exchanger; and the one or more medium-temperature compressors are configured to:

receive the second portion of compressed refrigerant, and pass the second portion of compressed refrigerant to the flash tank.

3. The refrigeration system of claim 2, further comprising:

a three-way valve positioned between the one or more low-temperature compressors and the heat exchanger and configured to pass the second portion of compressed refrigerant from the one or more low-temperature compressors to the heat exchanger and pass the first portion of compressed refrigerant to the one or more medium-temperature compressors.

4. The refrigeration system of claim 3, wherein the controller is communicatively coupled to the three-way valve and the controller is further configured to:

determine a defrost time for the first low-temperature evaporator;

compare the defrost time to a predetermined threshold; and cause the three-way valve to decrease the compressed refrigerant provided to the heat exchanger when the defrost time is less than the predetermined threshold.

5. The refrigeration system of claim 3, wherein the controller is communicatively coupled to the three-way valve and the controller is further configured to:

determine a defrost time for the first low-temperature evaporator;

compare the defrost time to a predetermined threshold; and cause the three-way valve to increase the compressed refrigerant provided to the heat exchanger when the defrost time is greater than the predetermined threshold.

6. The refrigeration system of claim 1, wherein the controller is further configured to determine that the second low-temperature evaporator should be operated in the defrost mode;

cause the second low-temperature evaporator to operate in the defrost mode by:

closing the first valve to prohibit defrost refrigerant from passing to the first low-temperature evaporator;

opening the second valve to allow output refrigerant from the first low-temperature evaporator to pass to the one or more compressors;

opening the third valve to allow defrost refrigerant to pass to the second low-temperature evaporator;

closing the fourth valve to prohibit output refrigerant from the second low-temperature evaporator from flowing to the one or more compressors; and causing defrost refrigerant from the second low-temperature evaporator to flow to the first low-temperature evaporator.

7. The refrigeration system of claim 6, further comprising:

a first bypass valve positioned between the first valve and the first low-temperature evaporator;

a second bypass valve positioned between the first low-temperature evaporator and the second valve;

a third bypass valve positioned between the third valve and the second low-temperature evaporator;

a fourth bypass valve positioned between the second low-temperature evaporator and the fourth valve;

wherein when the controller determines that operation of the first low-temperature evaporator is in the defrost mode, the controller causes the second bypass valve and the third bypass valve to open, which causes the defrost refrigerant from the first low-temperature evaporator to flow to the second low-temperature evaporator; and when the controller determines that the operation of the second low-temperature evaporator is in the defrost mode, the controller causes the first bypass valve and the fourth bypass valve to open, which causes the defrost refrigerant from the second low-temperature evaporator to flow to the first low-temperature evaporator.

8. The refrigeration system of claim 1, wherein the controller is further configured to:

determine that defrost mode operation of the first low-temperature evaporator is complete; and after determining that defrost mode operation of the first low-temperature evaporator is complete, cause the first low-temperature evaporator to operate in a refrigeration mode.

9. The refrigeration system of claim 1, wherein a plurality of evaporators comprises a third low-temperature evaporator, and when the first low-temperature evaporator is in the defrost mode, the second low-temperature evaporator and the third low-temperature evaporator are caused to operate in a refrigeration mode.

10. The refrigeration system of claim 1, wherein a plurality of evaporators comprises a third low-temperature evaporator, and wherein the first low-temperature evaporator and the second low-temperature evaporator are operated in the defrost mode while the third low-temperature evaporator is caused to operate in a refrigeration mode.

11. A method of operating a refrigeration system, the method comprising:

operating a first low-temperature evaporator and a second low-temperature evaporator in a refrigeration mode;

determining that the first low-temperature evaporator should be operated in a defrost mode; and causing the first low-temperature evaporator to operate in the defrost mode, after determining the first low-temperature evaporator should be operated in the defrost mode by:

opening a first valve to allow defrost refrigerant to pass from a heat exchanger to the first low-temperature evaporator;

closing a second valve to prohibit output refrigerant from the first low-temperature evaporator from passing to one or more compressors;

closing a third valve to prohibit defrost refrigerant from passing to the second low-temperature evaporator;

opening a fourth valve to allow output refrigerant from the second low-temperature evaporator to flow to the one or more compressors; and causing defrost refrigerant from the first low-temperature evaporator to flow to the second low-temperature evaporator;

wherein:

the heat exchanger is configured to receive warm liquid from a flash tank and a portion of compressed refrigerant from the one or more compressors, and the heat exchanger is configured to extract heat from the portion of the compressed refrigerant and add it to the warm liquid to produce the defrost refrigerant.

12. The method of claim 11, further comprising:

determining a defrost time for the first low-temperature evaporator;

comparing the defrost time to a predetermined threshold; and causing a three-way valve to increase the portion of compressed refrigerant provided to the heat exchanger when the defrost time is less than the predetermined threshold;

wherein:

the one or more compressors comprise one or more low-temperature compressors and one or more medium-temperature compressors, and the three-way valve is positioned between the one or more low-temperature compressors and the heat exchanger and configured to pass the portion of compressed refrigerant from one or more low-temperature compressors to the heat exchanger and pass a second portion of compressed refrigerant to one or more medium-temperature compressors.

13. The method of claim 11, further comprising:

determining a defrost time for the first low-temperature evaporator;

comparing the defrost time to a predetermined threshold; and causing a three-way valve to increase the compressed refrigerant provided to the heat exchanger when the defrost time is greater than the predetermined threshold;

wherein:

the one or more compressors comprise one or more low-temperature compressors and one or more medium-temperature compressors, and the three-way valve is positioned between the one or more low-temperature compressors and the heat exchanger and configured to pass the portion of compressed refrigerant from one or more low-temperature compressors to the heat exchanger and pass a second portion of compressed refrigerant to one or more medium-temperature compressors.

14. The method of claim 11, further comprising:

determining that the second low-temperature evaporator should be operated in the defrost mode; and causing the second low-temperature evaporator to operate in the defrost mode by:

closing the first valve to prohibit defrost refrigerant from passing to the first low-temperature evaporator;

opening the second valve to allow output refrigerant from the first low-temperature evaporator to pass to the one or more compressors;

opening the third valve to allow defrost refrigerant to pass to the second low-temperature evaporator;

closing the fourth valve to prohibit output refrigerant from the second low-temperature evaporator from flowing to the one or more compressors; and causing defrost refrigerant from the second low-temperature evaporator to flow to the first low-temperature evaporator.

15. The method of claim 11, further comprising:

causing a first bypass valve and a fourth bypass valve to open, when the second low-temperature evaporator is in the defrost mode; and causing a second bypass valve and a third bypass valve to open, when the first low-temperature evaporator is in the defrost mode;

wherein:

the first bypass valve is positioned between the first valve and the first low-temperature evaporator, the second bypass valve positioned between the first low-temperature evaporator and the second valve, the third bypass valve is positioned between the third valve and the second low-temperature evaporator, the fourth bypass valve is positioned between the second low-temperature evaporator and the fourth valve, when the second bypass valve and the third bypass valve are open, defrost refrigerant flows from the first low-temperature evaporator to the second low-temperature evaporator, and when the first bypass valve and the fourth bypass valve are open, defrost refrigerant flows from the second low-temperature evaporator to the first low-temperature evaporator.

16. The method of claim 11, further comprising:

determining that the defrost mode operation of the first low-temperature evaporator is complete; and causing the first low-temperature evaporator to operate in a refrigeration mode, after determining that the defrost mode operation of the first low-temperature evaporator is complete.

17. A controller of a refrigeration system, the controller comprising:

an input/output interface communicatively coupled to:

a first valve positioned between a heat exchanger and a first low-temperature evaporator and configured to pass, when open, defrost refrigerant to the first low-temperature evaporator;

a second valve positioned between the first low-temperature evaporator and one or more compressors and configured to pass, when open, output refrigerant from the first low-temperature evaporator to the one or more compressors;

a third valve positioned between the heat exchanger and a second low-temperature evaporator and configured to pass, when open, defrost refrigerant to the second low-temperature evaporator;

a fourth valve positioned between the second low-temperature evaporator and the one or more compressors configured to pass, when open, output refrigerant from the second low-temperature evaporator to the one or more compressors; and a processor configured to:

determine that the first low-temperature evaporator should be operated in a defrost mode; and after determining the first low-temperature evaporator should be operated in the defrost mode, cause the first low-temperature evaporator to operate in the defrost mode by:

opening the first valve to allow defrost refrigerant to pass to the first low-temperature evaporator;

closing the second valve to prohibit output refrigerant from the first low-temperature evaporator from passing to the one or more compressors;

closing the third valve to prohibit defrost refrigerant passing to the second low-temperature evaporator;

opening the fourth valve to allow output refrigerant from the second low-temperature evaporator to flow to the one or more compressors; and causing defrost refrigerant from the first low-temperature evaporator to flow to the second low-temperature evaporator.

18. The controller of claim 17, wherein the processor is further configured to:

determine a defrost time for the first low-temperature evaporator;

compare the defrost time to a predetermined threshold; and cause a three-way valve to increase a portion of compressed refrigerant provided from the one or more compressors to the heat exchanger when the defrost time is greater than the predetermined threshold;

wherein:

the one or more compressors comprise one or more low-temperature compressors and one or more medium-temperature compressors, and the three-way valve is positioned between the one or more low-temperature compressors and the heat exchanger and configured to pass the portion of compressed refrigerant from one or more low-temperature compressors to the heat exchanger and pass a second portion of compressed refrigerant to one or more medium-temperature compressors.

19. The controller of claim 17, wherein the processor is further configured to:

determine that the second low-temperature evaporator should be operated in the defrost mode; and cause the second low-temperature evaporator to operate in the defrost mode by:

closing the first valve to prohibit defrost refrigerant from passing to the first low-temperature evaporator;

opening the second valve to allow output refrigerant from the first low-temperature evaporator to pass to the one or more compressors;

opening the third valve to allow defrost refrigerant to pass to the second low-temperature evaporator;

closing the fourth valve to prohibit output refrigerant from the second low-temperature evaporator from flowing to the one or more compressors; and causing defrost refrigerant from the second low-temperature evaporator to flow to the first low-temperature evaporator.

20. The controller of claim 17, wherein the processor is further configured to:

determine that the defrost mode operation of the first low-temperature evaporator is complete; and cause the first low-temperature evaporator to operate in a refrigeration mode, after determining that the defrost mode operation of the first low-temperature evaporator is complete.

* * * * *